United States Patent [19]

Nakazawa et al.

[11] 4,214,907

[45] Jul. 29, 1980

[54] PHOTOSENSITIVE MATERIAL FOR ELECTROPHOTOGRAPHY HAVING A POLYVINYL CARBAZOLE DERIVATIVE, PHTHALOCYANINE, AND AN ELECTRON-ACCEPTOR

[75] Inventors: Toru Nakazawa, Osaka; Keiichi Nagahashi, Kaizuka; Tatsuo Aizawa, Osaka, all of Japan

[73] Assignee: Mita Industrial Company, Ltd., Osaka, Japan

[21] Appl. No.: 867,302

[22] Filed: Jan. 5, 1978

[51] Int. Cl.[2] ..... G03G 5/14; G03G 5/06

[52] U.S. Cl. ..... 430/82; 430/83

[58] Field of Search ..... 96/1.5, 1 PC, 1 PE, 96/1.6

[56] References Cited

U.S. PATENT DOCUMENTS

| | | | |
|---|---|---|---|
| 3,573,906 | 4/1971 | Gotte | 96/1.5 R |
| 3,816,118 | 6/1974 | Byrne | 96/1.5 |
| 3,926,629 | 12/1975 | Weigl | 96/1.5 |
| 3,953,207 | 4/1976 | Horgan | 96/1.5 |

*Primary Examiner*—Roland E. Martin, Jr.
*Assistant Examiner*—John L. Goodrow
*Attorney, Agent, or Firm*—Sherman & Shalloway

[57] ABSTRACT

In a photosensitive material for electrophotography, an intermediate layer comprising an organic polymeric photoconductor and a polycyclic aromatic nitro compound at a specific ratio is formed on an electrically conductive substrate, and a top layer comprising, incorporated in a binder, phthalocyanine or phthalocyanine derivative and the above polycyclic aromatic nitro compound at a specific ratio is laminated on the intermediate layer. In this photosensitive material, the dark decay speed is controlled in a range suitable for application to the repeated copying operation and the residual potential left on the exposure area can be reduced to a negligible level. Accordingly, occurrence of fogging is prevented and the toner transfer efficiency is improved. Further, this photosensitive material has improved mechanical, chemical and electric durabilities, and therefore, the life of the photosensitive material is remarkably prolonged.

4 Claims, No Drawings

PHOTOSENSITIVE MATERIAL FOR ELECTROPHOTOGRAPHY HAVING A POLYVINYL CARBAZOLE DERIVATIVE, PHTHALOCYANINE, AND AN ELECTRON-ACCEPTOR

BACKGROUND OF THE INVENTION (1) Field of the Invention

This invention relates to a photosensitive material for electrophotography which has a novel laminate structure. More particularly, the invention relates to a photosensitive material for electrophotography which comprises an electrically conductive substrate, an intermediate layer formed on said substrate and a top layer laminated on said intermediate layer, wherein said intermediate layer comprises (A) an organic polymeric photoconductor and (B) an polycyclic aromatic nitro compound at an (A)/(B) weight ratio of from 6/1 to 1/6 and said top layer comprises, incorporated in a binder, (C) phthalocyanine or a phthalocyanine derivative and (B) said polycyclic aromatic nitro compound at a (C)/(B) weight ratio of from 10/5 to 10/25.

(2) Description of the Prior Art

In the art of electrophotography, there is broadly adopted a process comprising charging a photosensitive material provided with a photoconductive layer by corona discharge or the like, exposing the photosensitive material imagewise to actinic rays to form an electrostatic latent image on the surface of the photoconductive layer, applying a developer to the surface of the photoconductive layer to form a toner image corresponding to said electrostatic latent image and transferring said toner image formed on the surface of the photoconductive layer onto a copying paper. In this conventional process, after the transfer of the toner image, the photosensitive material is fed to the cleaning step where the residual toner is removed, and it is then fed to the above-mentioned charging step and subsequent steps again.

An electrophotographic photosensitive material that is used repeatedly in the above-mentioned electrophotographic process is required to have some special properties different from properties required of a photosensitive material of the type where a toner is directly fixed on the photosensitive layer. More specifically, in order to prevent fogging in the repeated copying operation and prolong the life of the photosensitive material, it is necessary that the photosensitive material of the former type should have a relatively quick dark decay (the property that the surface potential of the non-exposed area of the photosensitive layer decays relatively quickly in the dark) and a residual potential as low as negligible (the property that the potential left on the exposed area of the photosensitive layer is as low as negligible). When the residual potential of the photosensitive material is high, it already causes fogging at the transfer step. Further, in this case or in the case where the dark decay speed of the photosensitive material is low, electrostatic charges on the electrostatic image formed on the surface of the photosensitive material or electrostatic charges generated for other reason are left on the surface of the photosensitive material even after the transfer and cleaning steps and they cause fogging at the next cycle of the copying operation. Moreover, if the dark decay speed is low, even after the transfer step, toner particles are electrostatically attracted to the surface of the photosensitive material by a relatively strong attracting force and therefore, the efficiency of transfer of the toner to a copying paper is relatively low and the surface of the photosensitive material must be wiped strongly to remove the residual toner from the surface of the photosensitive material. As a result, the surface of the photosensitive material is readily and quickly damaged and the life of the photosensitive material is shortened.

The photosensitive material of this repeatedly used type is also required to have a highly enhanced mechanical, electric or chemical durability. Namely, since the photosensitive material of this type undergoes repeatedly the discharge or irradiation treatment and receives repeatedly friction with a magnetic brush or cleaning member, the photoconductive layer of the photosensitive material is readily mechanically damaged or electrically or chemically deteriorated. Moreover, such a trouble as peeling of the photoconductive layer from the electrically conductive substrate is readily caused while the photosensitive material is being used.

As the substance for forming a photoconductive layer of a photosensitive material, there are known various organic and inorganic photoconductors. Among these known photoconductors, phthalocyanine and phthalocyanine derivatives have been noted as substances valuable for manufacture of photosensitive materials for electrophotography because their chemical and electric durabilities are excellent and they are easily available and cheap.

Photosensitive materials for electrophotography including phthalocyanine or its derivative as a photoconductor, however, fail to satisfy the foregoing requirements sufficiently. For example, a photosensitive material comprising a photoconductive layer composed of a dispersion of phthalocyanine or its derivative in an electrically insulating binder, which is formed on an electrically conductive substrate, is still defective in that the value of the surface potential at the charging step is generally low, the rising speed of the surface potential is low, the residual potential at the exposure step is still at a level that cannot be neglected and the speed of reduction of the potential in the non-exposed area, namely the dark decay speed, is low.

BRIEF SUMMARY OF THE INVENTION

We found that when an intermediate layer comprising (A) an organic polymeric photoconductor and (B) a polycyclic aromatic nitro compound at a specific ratio is formed on an electrically conductive substrate and a top layer comprising, incorporated in a binder, (C) phthalocyanine or a phthalocyanine derivative and (B) said polycyclic aromatic nitro compond at a specific ratio if formed on the intermediate layer, the dark decay speed of the resulting photosensitive material is controlled in a range suitable for application to the repeated copying operation and the residual potential can be reduced to a negligible level, whereby occurrence of fogging can be prevented, the toner transfer efficiency can be improved and the life of the photosensitive material can be prolonged. It also was found that a photosensitive material having this laminate structure is excellent in mechanical, chemical and electric durabilities.

More specifically, in accordance with this invention, there is provided a photosensitive material for electrophotography which comprises an electrically conductive substrate, an intermediate layer formed on said substrate and a top layer laminated on said intermediate layer, wherein said intermediate layer comprises (A) an organic polymeric photoconductor and (B) an electron-acceptable polycyclic aromatic nitro compound at an (A)/(B) weight ratio of from 6/1 to 1/6 and said top layer comprises, incorporated in a binder, (C) phthalocyanine or a phthalocyanine derivative and (B) said electron-acceptable polycyclic aromatic nitro compound at a (C)/(B) weight ratio of from 10/5 to 10/25.

DETAILED DESCRIPTION OF THE PREFERRED EMBODIMENTS

In this invention, as the organic polymeric photoconductor (A) constituting the intermediate layer, there can be used any of organic polymeric substances having photoconductivity, for example, poly-N-vinylcarbazole, poly-N-acrylphenothiazine, poly-N-(β-acryloxyethyl)-phenothiazine, poly-N-(2-acryloxypropyl)-phenothiazine, poly-N-allylcarbazole, poly-N-2acryloxy-2-methyl-N-ethylcarbazole, poly-N-(2-p-vinylbenzoylethyl)carbazole, poly-N-propenylcarbazole, poly-N-2-methylacryloxapropylcarbazole, poly-N-acrylcarbazole, poly-4-vinyl-p-(N-carbazyl)toluene, poly(vinylanisolacetophenone), polyindene and other known photoconductive organic polymeric substances. Polymeric photoconductors that are easily available and are suitable for attaining the objects of this invention include poly-N-vinylcarbazole and nuclear substitution derivatives thereof, for example, halogen- and alkyl-substituted derivatives.

In this invention, as the phthalocyanine or phthalocyanine derivative constituting the top layer of the laminated photosensitive material, there can be used phthalocyanine and all of known phthalocyanine derivatives having photoconductivity, for example, aluminum phthalocyanine, aluminum polychlorophthalocyanine, antimony phthalocyanine, barium phthalocyanine, beryllium phthalocyanine, cadmium hexadecachlorophthalocayanine, cadmium phthalocyanine, cerium phthalocyanine, chromium phthalocyanine, cobalt phthalocyanine, cobalt chlorophthalocyanine, copper 4-aminophthalocyanine, copper bromochlorophthalocyanine, copper 4-chlorophthalocyanine, copper 4-nitrophthalocyanine, copper phthalocyanine, phthalocyanine sulfonate, copper polychlorophthalocyanine, deuterio phthalocyanine, dysprosium phthalocyanine, erbium phthalocyanine, europium phthalocyanine, gadolinium phthalocyanine, gallium phthalocyanine, germanium phthalocyanine, holmium phthalocyanine, indium phthalocyanine, iron phthalocyanine, iron polyhalophthalocyanine, lanthanum phthalocyanine, lead phthalocyanine, lead polychlorophthalocyanine, cobalt hexaphenylphthalocyanine, copper pentaphenylphthalocyanine, lithium phthalocyanine, ruthenium phthalocyanine, magnesium phthalocyanine, manganese phthalocyanine, mercury phthalocyanine, molybdenum phthalocyanine, neodium phthalocyanine, nickel phthalocyanine, nickel polyhalophthalocyanine, osmium phthalocyanine, palladium phthalocyanine, palladium chlorophthalocyanine, alkoxyphthalocyanine, alkylaminophthalocyanine, alkylmercaptophthalocyanine, aryloxyphthalocyanine, arylmercaptophthalocyanine, copper phthalocyanine piperidine, cycloalkylaminophthalocyanine, dialkylaminophthalocyanine, diaralkylaminophthalocyanine, dicycloalkylaminophthalocyanine, hexadecahydrophthalocyanine, imidomethylphthalocyanine, 1,2-naphthalocyanine, 2,3-naphthalocyanine, octa-azophthalocyanine, sulfur phthalocyanine, tetra-azophthalocyanine, tetra-4-acetylaminophthalocyanine, tetra-4-aminobenzoylphthalocyanine, tetra-4-aminophthalocyanine, tetrachloromethylphthalocyanine, tetra-diazophthalocyanine, tetra-4,4-dimethylocta-azophthalocyanine, tetra-4,5-diphenyleneoxide-phthalocyanine, tetra-4,5-diphenylocta-azophthalocyanine, tetra-(6-methylbenzothiazoyl)phthalocyanine, tetra-p-methylphenylaminophthalocyanine, tetramethylphthalocyanine, tetranaphthotriazolylphthalocyanine, tetra-4-naphthylphthalocyanine, tetra-4-nitrophthalocyanine, tetraperinaphthylene-4,5-octa-azophthalocyanine, tetra-2,3-phenylene-oxide-phthalocyanine, tetra-4-phenylocta-azophthalocyanine, tetraphenylphthalocyanine, tetraphenylphthalocyanine-tetracarboxylic acid, tetraphenylphthalocyanine tetrabariumcarboxylate, tetraphenylphthalocyanine-tetra-4-trifluoromethylmercaptophthalocyanine, tetrapyridine-phthalocyanine, tetra-4-trifluoromethylmercaptophthalocyanine, tetra-4-trifluoromethylphthalocyanine-4,5-thionaphthene-octaazophthalocyanine, platinum phthalocyanine, potassium phthalocyanine, rhodium phthalocyanine, samarium phthalocyanine, silver phthalocyanine, silicon phthalocyanine, sodium phthalocyanine, sulfonated phthalocyanine, thorium phthalocyanine, thulium phthalocyanine, tin chlorophthalocyanine, tin phthalocyanine, titanium phthalocyanine, uranium phthalocyanine, vanadium phthalocyanine, ytteribium phthalocyanine, zinc chlorophthalocyanine, zinc phthalocyanine, and dimers, trimers, oligomers, polymers and copolymers thereof.

Phthalocyanine and phthalocyanine derivatives that are easily available and are especially suitable for attaining the objects of the present invention include metal-free phthalocyanines and their nuclear substitution derivatives, for example, halogen-substituted derivatives.

As the polycyclic aromatic nitro compound to be combined with the organic polymeric photoconductor (A) and the phthalocyanine or phthalocyanine derivative (C) in the intermediate layer and top layer of the laminated photosensitive material of this invention, there can be used any of polycyclic aromatic compounds having at least one nitro group substituted on the nucleus, for example, 2,4-dinitro-1-chloronaphthalene, 1,4-dinitronaphthalene, 1,5-dinitronaphthalene, 3-nitro-N-butylcarbazole, 4-nitrobiphenyl, 4,4'-dinitrobiphenyl, 1-chloro-4-nitroanthraquinone, 2,7-dinitroanthraquinone, 2,4,7-trinitrofluorenone, 2,4,5,7-tetranitrofluorenone, 9-dicyanomethylene-2,4,7-trinitrofluorenone and 4-nitroacenaphthene.

Polycyclic aromatic nitro compounds that are suitable for attaining the objects of this invention include trinitrofluoroenone and tetranitrofluorenone.

In the laminated photosensitive material of this invention, it is important that the phthalocyanine or phthalocyanine derivative (C) and the polycyclic aromatic nitro compound (B) should be incorporated in a binder at a (C)/(B) weight ratio of from 10/5 to 10/25, preferably from 10/8 to 10/20.

It is known that the phthalocyanine or phthalocyanine derivative (C) is used in combination with the polycyclic aromatic nitro compound (B) for a photoconductive layer. In known photosensitive materials, however, the polycyclic aromatic compound is used in an amount much smaller than the amount specified in this invention. When the polycyclic aromatic nitro compound is used in an amount smaller than the amount specified in this invention, as will be apparent from Comparative Example 1 and Table 1 given hereinafter, the dark decay speed is too low and the residual potential is at a level that cannot be neglected. Therefore, in this photoconductive layer, fogging is readily caused at the high-speed repeated copying operation and since a large load is imposed on the photoconductive layer at the cleaning step, the resistance to the copying operation (the frequency of the repeated copying operation that the photosensitive material can resist) is drastically lowered. When the polycyclic aromatic compound is used in an amount larger than the amount specified in this invention, as will be apparent from Comparative Example 2 and Table 1 given hereinafter, the residual potential can be reduced substantially to zero, but the dark decay speed is too high and it is difficult to obtain a copied image having high contrast and density. In contrast, if the mixing ratio of the polycyclic aromatic nitro compound to the phthalocyanine or phthalocyanine derivative is adjusted within the above-mentioned range according to this invention, at the high-speed repeated copying operation, the residual potential can be reduced to a negligible level and the dark decay speed can be controlled so that the potential is abruptly lowered during a period ranging from the toner transfer step to the point of initiation of the cleaning operation. Therefore, according to this invention, it is possible to attain effects of improving the toner image transfer efficiency, facilitating the cleaning operation, preventing occurrence of fogging and improving the resistance to the copying operation concurrently.

This functional effect that when the polycyclic aromatic nitro compound is combined with the phthalocyanine or phthalocyanine derivative at the above-mentioned specific mixing ratio, the polycyclic aromatic nitro compound acts as a dark decay speed controlling agent for the phthalocyanine or phthalocyanine derivative is a novel effect found by us for the first time.

As the binder for dispersing therein the phthalocyanine or phthalocyanine derivative and the polycyclic aromatic nitro compound, there can be used any of known polymeric binders, especially electrically insulating binders. More specifically, there can be used, for example, acrylic resins such as polyacrylic acid esters, polymethacrylic acid esters, acrylic acid/methacrylic acid ester copolymers, acrylic acid/styrene copolymers and maleic anhydride/styrene/methacrylic acid ester copolymers, vinyl aromatic polymers such as polystyrene and poly-methylstyrene, vinyl chloride resins such as vinyl chloride/vinyl acetate copolymers, partially saponified vinyl chloride/vinyl acetate copolymers, partially saponified and acetalized vinyl chloride/vinyl acetate copolymers and vinyl chloride/vinyl acetate/-maleic anhydride copolymers, vinyl ester polymers such as polyvinyl acetate, butadiene copolymers such as styrene/butadiene copolymers and acrylonitrile/-styrene/butadiene copolymers, olefin resins such as ethylene/vinyl acetate copolymers, ethylene/acrylic acid copolymers and ionomers, polyester resins such as ethylene/butylene-terephthalate/isophthalate, polyamide and copolyamide resins, polycarbonate resins, unsaturated polyester resins, urethane resins such as acrylic urethane, epoxy resins, phenol-formaldehyde resins, xylene resins and melamine-formaldehyde resins. These binders may be used singly or in the form of a mixture of two or more of them. It is preferred that the electric resistance (volume resistivity) of the binder used be at least $1\times10^{11}\Omega-$cm. In order to attain the objects of this invention, it is especially preferred to use an acrylic resin as a binder.

The amount used of the binder is not particularly critical in this invention, but in general, it is preferred that the binder be used in an amount of 100 to 1000 parts by weight, especially 300 to 500 parts by weight, per 100 parts by weight of the phthalocyanine or phthalocyanine derivative (C).

In this invention, it is preferred that a silicone oil be incorporated in the top layer comprising the phthalocyanine or phthalocyanine derivative, the polycyclic aromatic nitro compound and the binder. We found that when a silicone oil is incorporated in the top layer, during the exposure and developing steps the dark decay speed can be maintained at a relatively low level and at the subsequent transfer or cleaning step the dark decay speed can be elevated at an extremely high level to thereby reduce drastically the residual potential on the non-exposed area. According to this preferred embodiment, accumulation of charges can be effectively prevented and there can be attained prominent effects of preventing occurrence of fogging, improving the toner transfer efficiency, preventing occurrence of insulation breakdown and improving the adaptability to the cleaning operation. Still further, in this preferred embodiment, the coating operation can be remarkably facilitated and the smoothness of the coating layer can be prominently improved.

As the silicon oil that can be used in this invention, there can be mentioned, for example, polydimethylsiloxane, polymethylphenylsiloxane, polyhydrodienemethylsiloxane, polymethylaminopropylsiloxane, their copolymers, and dimethylsiloxane/ethylene oxide block copolymers. Polydimethylsiloxane is especially preferred because it is easily available and is suitable for attaining the objects of this invention.

The amount incorporated of the silicone oil may be changed in a broad range, but in general, in order to attain the objects of this invention advantageously, it is preferred that the silicone oil be incorporated in an amount of 5 to 150 parts by weight, especially 25 to 85 parts by weight, per 100 parts by weight of the phthalocyanine or phthalocyanine derivative (C).

In this invention, it is very important that an intermediate layer comprising the above-mentioned organic polymeric photoconductor (A) and polycyclic aromatic nitro compound (B) at a specific mixing ratio should be interposed between the electrically conductive substrate and the top layer (first photoconductive layer) comprising the above-mentioned phthalocyanine or phthalocyanine derivative, polycyclic aromatic nitro compound and binder. More specifically, in case of a photosensitive plate formed by laminating a photoconductive layer comprising the above-mentioned phthalocyanine or phthalocyanine derivative, polycyclic aromatic nitro compound and binder directly on an electrically conductive substrate, as will be apparent from Comparative Example 5 and Table 1 given hereinafter, the primary surface potential (the surface potential of the photosensitive material after charging but before exposure) is considerably low, the rising speed of the surface potential is low and the sensitivity expressed by the half life (seconds) of light decay is considerably low. Thus, this comparative photosensitive material is still insufficient in various points. In contrast, when a layer (second photoconductive layer) comprising the above-mentioned organic polymeric photoconductor (A) and polycyclic aromatic nitro compound (B) is disposed between the top layer (first photoconductive layer) and the electrically conductive substrate according to this invention, the foregoing properties can be remarkably improved without any bad influence on dark decay characteristics, which will readily be understood when results of Comparative Example 5 are compared with results of Example 1 of this invention.

It also is very important that in the intermediate layer of the photosensitive material of this invention, the organic polymeric photoconductor (A) should be combined with the polycyclic aromatic nitro compound (B) at an (A)/(B) mixing weight ratio of from 6/1 to 1/6, especially from 1/1.7 to 1/2.2.

It is known that a polymeric photoconductor as an electron donor and a polycyclic aromatic nitro compound as an electron acdeptor form a complex and a sensitized photoconductive layer can be formed from these two compounds. In the intermediate layer of this invention, the polycyclic aromatic compound performs a function of controlling the charge characteristic of the surface of the photosensitive material, namely the first photoconductive layer, when incorporated in the above-mentioned specific amount. When the amount of the polycyclic aromatic nitro compound incorporated in the intermediate layer is smaller than the above amount specified in this invention, as will be apparent from Comparative Example 3 and Table 1 given hereinafter, during the repeated copying operation the residual potential is accumulated on the surface of the photosensitive material, causing fogging, electric deterioration of the photoconductive layer and drastic reduction of the resistance to the copying operation. When the amount of the polymeric photoconductor is larger than the amount specified in this invention, as will be apparent from Comparative Example 4 and Table 1 given hereinafter, the primary surface potential is drastically reduced and the rising speed of the surface potential is low. Accordingly, it is difficult to obtain satisfactory copied images. In contrast, when the polymeric photoconductor is combined with the polycyclic aromatic nitro compound at the above-mentioned specific weight ratio according to this invention, the charge characteristics of the surface of the photoconductive layer can be controlled so that the residual potential can be reduced to a level that can be neglected while elevating the primary surface potential and the speed of rising of the surface potential by charging to sufficiently high levels and bad influences owing to accumulation of the residual potential can be effectively eliminated.

In this invention, a foil or plate of copper, aluminum, silver, tin or iron, which is formed into a sheet or drum, is used as the electrically conductive substrate. Further, a product formed by depositing such metal in the form of a thin film on a plastic film or the like by vacuum deposition, non-electrolytic plating or like means can be used as the electrically conductive substrate.

In general, the laminated photosensitive material of this invention is prepared by a process comprising coating a solution containing the organic polymeric photoconductor (A) and the polycyclic aromatic nitro compound (B) at the above-mentioned specific ratio on an electrically conductive substrate such as mentioned above to form an intermediate layer, drying the so coated intermediate layer, coating a liquid composition comprising, incorporated in a binder such as mentioned above, the phthalocyanine or phthalocyanine derivative (C) and the polycyclic aromatic nitro compound (B) at the above-mentioned specific ratio on the intermediate layer, and drying the coating according to need.

As the solvent for preparing a coating composition for the intermediate layer, there can be used, for example, aromatic hydrocarbon solvents such as benzene, toluene and xylene, cyclic ethers such as dioxane and tetrahydrofuran, ketones such as acetone, methylethyl ketone, methylisobutyl ketone and cyclohexanone, alcohols such as diacetone alcohol and ethylene glycol isobutyl ether, and alicyclic hydrocarbons such as cyclohexane. These solvents may be used singly or in the form of a mixture of two or more of them.

In general, it is preferred that this coating composition be applied to the electrically conductive substrate at a solid concentration of 1 to 80% by weight, especially 5 to 30% by weight. The coated composition is ordinarily dried at a temperature of 10° to 200° C. to form an intermediate layer.

In the above process, a complex is formed from the organic polymeric photoconductor (A) and the polycyclic aromatic nitro compound (B) in the coating solution. In this invention, it also is possible to adopt a process in which a solution of the organic polymeric photoconductor (A) and a solution of the polycyclic aromatic nitro compound (B) are prepared separately, the respective solutions are coated on the electrically conductive substrate in this order or reverse order and a complex is formed directly on the electrically conductive substrate. In this case, even if the complex layer is not formed uniformly throughout the intermediate layer, no particular disadvantage is brought about.

In general, a coating composition for forming the top layer is prepared by dissolving a binder such as mentioned above in one or more of the above-mentioned organic solvents, dispersing or dissolving the phthalocyanine or phthalocyanine derivative and the polycyclic aromatic nitro compound into the binder solution, and homogenizing the resulting dispersion or solution. From the viewpoint of the adaptability to the coating operation, it is generally preferred that the solid concentration of this coating composition be 1 to 80% by weight, especially 5 to 30% by weight.

In forming the top layer, it is preferred that the following be taken into consideration. Namely, it is preferred to select as the solvent of the top layer-forming coating composition a solvent that does not substantially dissolve a complex formed from the organic polymeric photoconductor and polycyclic aromatic nitro compound constituting the intermediate layer. Of course, it is permissible to use a solvent capable of substantially dissolving the intermediate layer for the top layer-forming coating composition. In this case, however, it is preferred that the top layer-forming composition be solidified within 5 minutes, especially 1 minute.

In the laminated photosensitive material of this invention, it is preferred that the thickness of the intermediate layer be 0.1 to 10$\mu$, especially 1 to 8$\mu$, and that the thickness of the top layer be 0.1 to 30$\mu$, especially 1 to 15$\mu$. If the thickness of the intermediate layer is smaller than 0.1$\mu$, the primary surface potential or rising speed thereof is often too low, and if the thickness of the intermediate layer is larger than 10$\mu$, the residual potential is at a level that cannot be neglected and occurrence of fogging or reduction of the resistance to the copying operation is readily caused. When the thickness of the top layer is smaller than 0.1$\mu$, the primary surface potential or rising speed thereof is often too low, and when the thickness of the top layer is larger than 30$\mu$, the sensitivity, i.e., the light decay speed, is reduced and insulation breakdown is readily caused.

In the laminated photosensitive material of this invention, as described hereinbefore, electric characteristics and photoconductive characteristics at the repeated copying operation can be remarkably improved, and furthermore, mechanical properties such as the peel resistance can be prominently improved. More specifically, although in case of a photosensitive material formed by applying a photoconductive layer comprising the above-mentioned phthalocyanine or phthalocyanine derivative, polycyclic aromatic nitro compound and binder directly to a metal substrate, the photoconductive layer is readily peeled off at a pressure-sensitive tape peel test described hereinafter, in case of the laminated photosensitive material of this invention, peeling of the photoconductive layer is not caused at all at the same test. Thus, it will readily be understood that in the laminated photosensitive material of this invention, also the mechanical properties are remarkably improved.

The laminated photosensitive material of this invention is especially valuable and useful as a photosensitive material for an electrophotographic copying machine in which the surface of the photosensitive material is positively charged and the photosensitive material is used repeatedly for the copying operation.

This invention will now be described in detail by reference to the following Examples that by no means limit the scope of the invention.

EXAMPLE 1

In tetrahydrofuran were homogeneously dissolved 10 g of polyvinylcarbazole (hereinafter referred to as "PVK") (Luvican M-170 manufactured by BASF AG.) and 20 g of 2,4,7-trinitrofluorenone (hereinafter referred to as "TNF"), and the solution was coated on an aluminum foil having a thickness of 40μ so that the dry thickness was 4μ, whereby an intermediate layer was formed. Then, 3 g of Phthalocyanine Blue (hereinafter referred to as "PC") (Heliogen Blue 7800 manufactured by BASF AG.), 3 g of TNF and 35 g of an acrylic resin (FR-1112D manufactured by Mitsubishi Rayon K. K., solid content=40% by weight) were homogeneously dispersed in 139 g of toluene, and the dispersion was coated on the intermediate layer so that the dry coating thickness was 10μ as a whole. Then, the coating was dried at 100° C. for 10 minutes. Thus, a photosensitive plate of the present invention was prepared.

Comparative photosensitive plates were prepared for evaluating the properties of the photosensitive plate of this invention.

Comparative Example 1

A photosensitive plate was prepared in the same manner as described in Example 1 except that the amount of TNF in the top layer-forming coating composition was changed to 0.3 g.

Comparative Example 2

A photosensitive plate was prepared in the same manner as described in Example 1 except that the amount of TNF in the top layer-forming coating composition was changed to 10 g.

Comparative Example 3

A photosensitive plate was prepared in the same manner as described in Example 1 except that the amount of TNF in the intermediate layer-forming coating composition was changed to 1 g.

Comparative Example 4

A photosensitive plate was prepared in the same manner as described in Example 1 except that the amount of TNF in the intermediate layer-forming coating composition was changed to 100 g.

Comparative Example 5

In 139 g of toluene were homogeneously dispersed 3 g of PC, 0.5 g of TNF and 35 g of an acrylic resin (FR-1112D), and the dispersion was coated on an aluminum foil having a thickness of 40μ so that the dry thickness was the same as in Example 1 (10μ). Then, the coating was dried at 100° C. for 10 minutes to form a photosensitive plate.

The photosensitive plate obtained in Example 1 was tested by using a tester of the positive charging-exposure-developing-transfer-fixing type. Clear images having a high resolving power were obtained. Several thousand prints could be obtained when the copying operation was repeated by using this photosensitive plate.

Electric characteristics of the photosensitive plate obtained in Example 1 were examined by using an electrostatic paper analyzer manufactured by Kawaguchi Denki K. K. to obtain results shown in Table 1.

The comparative photosensitive plates were similarly subjected to the copying test and their electric properties were similarly examined. Obtained results are shown in Table 1.

Table 1

| | Example 1 (laminate) | Comparative Example 1 (laminate) | Comparative Example 2 (laminate) | Comparative Example 3 (laminate) | Comparative Example 4 (laminate) | Comparative Example 5 (mono-layer) |
|---|---|---|---|---|---|---|
| Copying Characteristics | | | | | | |
| sharpness | ○ | X | Δ | Δ | Δ | X |
| density | ○ | ○ | X | ○ | X | X |
| fogging | ○ | X | ○ | X | ○ | X |
| cleaning property | ○ | X | ○ | X | Δ | Δ |
| resistance to copying operation | ○ | X | Δ | Δ | Δ | X |
| transfer efficiency | ○ | X | ○ | Δ | ○ | X |
| Electric Characteristics | | | | | | |
| sensitivity (Lux . sec) | 16 | 30 | 17 | 25 | 18 | 27 |
| initial potential (Volt) | 460 | 450 | 455 | 470 | 350 | 380 |
| charge quantity (Volt) | 500 | 560 | 480 | 520 | 400 | 410 |
| residual potential (Volt) | 10 | 30 | 7 | 40 | 9 | 41 |
| dark decay (Volt/sec) | 60 | 25 | 100 | 10 | 51 | 7 |
| Other | | | | | | |

Table 1-continued

| | Example 1 (laminate) | Comparative Example 1 (laminate) | Comparative Example 2 (laminate) | Comparative Example 3 (laminate) | Comparative Example 4 (laminate) | Comparative Example 5 (mono-layer) |
|---|---|---|---|---|---|---|
| adhesiveness | ○ | ○ | Δ | ○ | Δ | X |

Notes
Sharpness:
Reproducibility of fine lines, meshes, half-tones and small letters, which was evaluated according to the following scale:
○: good
Δ: slightly bad
X: bad
Density:
The density of the image area (non-exposed area), which was evaluated according to the following scale:
○: dense
Δ: slightly thin
X: thin
Fogging:
Contamination of the background in the non-image area (exposure area), which was evaluated according to the following scale:
○: not observed
Δ: slight
X: conspicuous
Cleaning Property:
Easiness in removing the toner left on the photosensitive plate after transfer, which was evaluated according to the following scale:
○: very easy
Δ: slightly difficult
X: difficult
Resistance to Copying Operation:
The number of good quality prints obtained at the repeated copying operation, which was evaluated according to the following scale:
○: more than 1000 prints
Δ: 500–1000 prints
X: less than 500 prints
Transfer Efficiency:
The ratio of the toner transferred to copying paper after development, which was evaluated according to the following scale:
○: more than 80% of the toner was transferred
Δ: 50 to 80% of the toner was transferred
X: less than 50% of the toner was transferred
Conditions for Measurements by Electrostatic Paper Analyzer:
Light: 40 Lux
Charge: 5 KV (positive)
Sensitivity: quantity of light (Lux . sec) at which the potential just before exposure decayed at ½, which was determined according to the static method
Initial potential: saturation charge (V) voltage as determined according to the static method
Charge quantity: saturation charge voltage (V) observed when charging was effected for 10 seconds, which was determined according to the dynamic method
Residual potential: voltage (V) observed 3 seconds after exposure, which was determined according to the static method
Dark decay: average value of the potential decay (V/sec) over a period of 3 seconds from charge-off, which was determined according to the static method
Adhesiveness:
The adhesion strength of the photosensitive layer to the aluminum substrate (the peel resistance observed when an pressure-sensitive adhesive tape was applied to the photosensitive layer and the tape was then peeled off), which was evaluated according to the following scale:
○: strong
Δ: ordinary
X: weak

EXAMPLE 2

In 80 g of a mixed solvent of toluene/cyclohexanone (3/1 weight ratio) were homogeneously dissolved 10 g of PVK (Tuvical 210 manufactured by Takasago Koryo K. K.) and 10 g of TNF, and the solution was coated an aluminum foil having a thickness of 40μ so that the dry thickness was 5μ, whereby an intermediate layer was formed. Then, 3 g of Phthalocyanine Blue (Heliogen Blue 7800 manufactured by BASF AG.), 4 g of TNF and 30 g of an acrylic resin (Acrydic A-196 manufactured by Dai-Nippon Ink Kagaku Kogyo K. K., solid content=50%) were homogeneously dispersed in 100 g of toluene, and the dispersion was coated on the intermediate layer so that the dry coating thickness was 10μ as a whole. The coating was then dried at 100° C. for 10 minutes to obtain a photosensitive plate.

When this photosensitive plate was tested in the same manner as described in Example 1, good results similar to the results obtained in Example 1 were obtained.

EXAMPLE 3

A photosensitive plate was prepared in the same manner as described in Example 1 except that an epoxy resin (Epikote 1009 manufactured by Shell Chemical Co.) was used instead of the acrylic resin in such an amount that the amount of the solids was the same as in the acrylic resin used in Example 1 and acetone was used as the solvent instead of toluene. When this photosensitive plate was tested, good results similar to the results obtained in Example 1 were obtained.

EXAMPLE 4

A photosensitive plate was prepared in the same manner as described in Example 1 except that a polyester resin (Vylon 113 manufactured by Toyo Boseki K. K.) was used instead of the acrylic resin used in Example 1. When this photosensitive plate was tested, good results similar to the results obtained in Example 1 were obtained.

EXAMPLE 5

When a curing agent (Epicure manufactured by Shell Chemical Co.) was added in forming the top layer in Example 3 in an amount of 5% by weight based on Epikote 1009, the durability was further improved in the resulting photosensitive plate.

EXAMPLE 6

A photosensitive plate was prepared in the same manner as described in Example 1 except that 1 g of a silicone oil (KF-96 manufactured by Shinetsu Kagaku Kogyo K. K.) was added to the top layer-forming coating composition. When this photosensitive plate was tested in the same manner as described in Example 1, it was found that the resistance to the copying operation and the cleaning property of this photosensitive plate were further improved over the photosensitive plate obtained in Example 1.

EXAMPLE 7

A photosensitive plate was prepared in the same manner as described in Example 1 except that in the intermediate layer-forming coating composition, TNF was replaced by the same amount of 2,4,5,7-tetranitrofluorenone. When this photosensitive plate was tested in the same manner as described in Example 1, good results similar to the results obtained in Example 1 were obtained.

EXAMPLE 8

A photosensitive plate was prepared in the same manner as described in Example 1 except that in the intermediate coating-forming composition, poly-N-2-acrylcarbazole was used instead of PVK. When this photosensitive plate was tested, good results similar to the results obtained in Example 1 were obtained.

EXAMPLE 9

A photosensitive plate was prepared in the same manner as described in Example 1 except that Resino Blue RSP (copper phthalocyanine manufactured by Resino Color Kogyo K. K.) was used instead of Heliogen Blue 7800. When this photosensitive plate was tested in the same manner as described in Example 1, good results similar to the results obtained in Example 1 were obtained.

What we claim is:

1. A laminated photosensitive material for electrophotography which comprises an electrically conductive substrate, an intermediate layer formed on said substrate and a top layer laminated on said intermediate layer wherein said intermediate layer comprises (A) polyvinyl carbazole or a nuclear substitution derivative thereof and (B) an electron-acceptable polycyclic aromatic nitro compound selected from the group consisting of trinitrofluorenone and tetranitrofluorenone at an (A)/(B) weight ratio of from 1/1.7 to 1/2.2 and has a thickness of 0.1 to 10 microns and said top layer comprises, incorporated in a binder, (C) phthalocyanine or a phthaloycanine derivative and (B) said electron-acceptable polycyclic aromatic compound at (C)/(B) weight ratio of from 10/8 to 10/20 and has a thickness of 0.1 to 30 microns.

2. A photosensitive material as set forth in claim 1 wherein the phthalocyanine or phthalocyanine derivative is at least one member selected from the group consisting of metal-free phthalocyanines and nuclear substitution derivatives thereof.

3. A photosensitive material as set forth in claim 1 wherein the binder is an acrylic resin.

4. A photosensitive material as set forth in claim 1 wherein the top layer further comprises a silicone oil in an amount of 5 to 150 parts by weight per 100 parts by weight of the phthalocyanine or phthalocyanine derivative.

* * * * *